US006568930B2

(12) United States Patent
Schmidl et al.

(10) Patent No.: US 6,568,930 B2
(45) Date of Patent: May 27, 2003

(54) INTERNAL GEAR PUMP HAVING A RADIAL ADJUSTMENT

(75) Inventors: Matthias Schmidl, Gries (AT); Bernhard Rettenbacher, Abtenau (AT)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/965,066

(22) Filed: Sep. 27, 2001

(65) Prior Publication Data

US 2002/0110468 A1 Aug. 15, 2002

(30) Foreign Application Priority Data

Sep. 27, 2000 (DE) ..... 100 47 738

(51) Int. Cl.[7] ..... F04C 2/10; F04C 15/04
(52) U.S. Cl. ..... 418/109; 418/171
(58) Field of Search ..... 418/108, 109, 418/149, 166, 171

(56) References Cited

U.S. PATENT DOCUMENTS 1,505,707 A * 8/1924 Hill ..... 418/171

FOREIGN PATENT DOCUMENTS

| | | | | |
|---|---|---|---|---|
| DE | 2705256 | * | 8/1978 | ..... 418/171 |
| DE | 28 08 731 | | 9/1979 | |
| GB | 1233376 | * | 5/1971 | ..... 418/171 |
| JP | 63-223381 | * | 9/1988 | ..... 418/109 |
| JP | 1-125583 | * | 5/1989 | ..... 418/108 |

* cited by examiner

*Primary Examiner*—John J. Vrablik
(74) *Attorney, Agent, or Firm*—Michael J. Striker

(57) ABSTRACT

An internal gear pump has a housing, a toothed ring provided with inner teeth, a bearing ring supporting the toothed ring in the housing rotatably about a rotary axis, a toothed gear provided with outer teeth and engaging with the toothed ring, the toothed gear being rotatable in the housing about a rotary axis, the toothed gear or the toothed ring being rotatably driven, the rotary axis of the toothed ring being offset relative to the rotary axis of the toothed gear, and an adjusting device associated with the bearing ring for moving the bearing ring in a radial direction relative to the rotary axis of the toothed ring in the housing for an adjustment and for blocking it in an adjusted position.

7 Claims, 1 Drawing Sheet

INTERNAL GEAR PUMP HAVING A RADIAL ADJUSTMENT

BACKGROUND OF THE INVENTION

The present invention generally relates to internal gear pumps.

One of such internal gear pumps is disclosed for example in the German patent document DE 28 08 731 C2. This internal gear pump has a housing, in which a toothed ring provided with internal teeth is supported by a bearing ring rotatably about an axis. Moreover, it has a toothed pinion which is provided with outer teeth and engages with the toothed ring, and also turnably supported about an axis. The rotary axis of the toothed pinion is offset relative to the rotary axis of the toothed ring. The toothed ring or the toothed pinion is driven rotatably. A certain gap is required between the toothed pinion and the toothed ring in a radial direction relative to the rotary axes of the toothed pinion and the toothed ring, for avoiding clamping. On the other hand, this radial gap must be not too large, since thereby between the toothed pinion and the toothed gear gaps are produced from which the medium to be supplied by the internal gear pump passes, and therefore the efficiency of the internal gear pump can be worsened. For producing the internal gear pump, narrow tolerances of various components are prescribed, to hold the radial gap within a predetermined region. This leads to an expensive and complicated manufacture and mounting of the internal gear pump.

SUMMARY OF THE INVENTION

Accordingly, it is an object of the present invention to provide an internal gear pump of the above mentioned type, which avoids the disadvantages of the prior art.

In keeping with these objects and with others which will become apparent hereinafter, one feature of present invention resides, briefly stated, in an internal gear pump in which an adjusting device is associated with the bearing ring, so as to move the bearing ring in a radial direction relative to the rotary axis of the toothed ring in the housing to provide an adjustment and to block in a predetermined position.

When the internal gear pump is designed in accordance with the present invention the adjusting device provides an adjustment of the radial gap between the toothed gear and the toothed pinion. This makes possible the manufacture of the internal gear pump with greater tolerances and thereby reduced costs.

In accordance with another feature of the present invention, the adjusting device has an adjusting element which is displaceably guided in the housing in a radial direction and is connected with the bearing ring, and a fixing element which is accessible from the outer side of the housing and connected with the housing engages the adjusting element to displace the adjusting element in a radial direction and to block it in the adjusted position. This provides a simple design of the adjusting device.

In accordance with another feature of the present invention the adjusting element has a recess in which the fixing element engages transversely to the radial direction, the fixing element abuts against a side surface of the recess which faces radially the rotary axis of the toothed ring or faces away from it, the fixing element is connected movably with the housing in direction of its longitudinal axis and the side surface of the recess is inclined to the longitudinal surface of the fixing element, so that by moving the fixing element in direction of its longitudinal axis over the inclined side surface, the recess performs a movement of the adjusting element in the radial direction. This also simplifies the adjusting device.

In accordance with another feature of the present invention, the fixing element is formed as an adjusting screw which is screwed in a threaded opening in the housing, and during a rotary movement performs an adjusting movement in direction of its longitudinal axis. This provides a simple construction of the fixing element.

Finally, in accordance with another advantageous feature of the present invention, the bearing ring is supported via at least one elastic ring which is clamped between its outer surface and the housing, to produce a restoring force on the bearing ring which acts opposite to the adjusting force produced by the adjusting device on the bearing ring.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
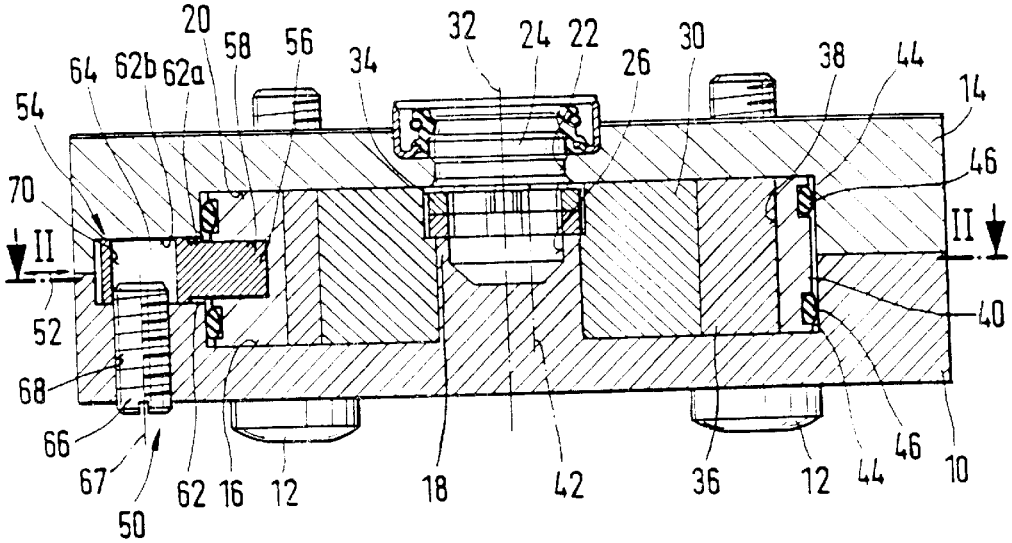
FIG. 1 is a view showing an internal gear pump in a cross-section taking along the line I—I in FIG. 2.
Figure 2:
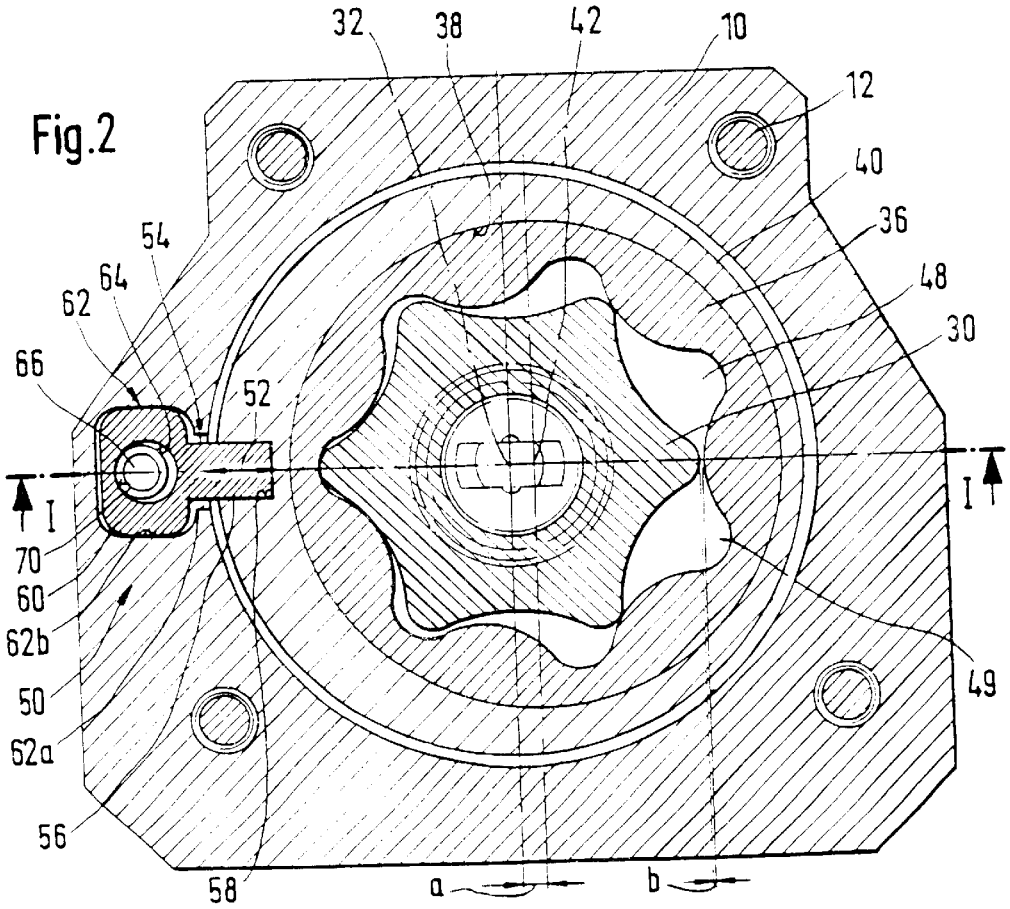
FIG. 2 is a view showing an internal gear pump in a cross-section taken along the line II—II in FIG. 1.

An internal gear pump shown in FIGS. 1 and 2 serves preferably for supplying fuel from a supply container to an internal combustion engine or a fuel high pressure pump or a fuel injection pump of a fuel injection system of an internal combustion engine. The internal combustion engine is preferably a self-igniting internal combustion engine, and the fuel supplied by the internal gear pump is diesel fuel.

The internal gear pump has for example a two-part housing with a housing part 10 and a cover part 14 which is connected with it by screws 12. The housing part 10 and the cover part 14 can be composed for example of metal, such as steel or aluminum and formed as cast parts. The housing part 10 at a side facing toward the cover part 14 has a depression 16 with at least approximately a circular cross-section. A pin 18 extends at least approximately centrally from the bottom of the depression 16 on the housing part 10 of one piece with it. The cover part 14 at its side facing the housing part 10 also has a depression 20, which is arranged and formed at least approximately in alignment with the depression 16 of the housing part 10. The housing part 10 and the housing part 14 with their depressions 16 and 20 form a chamber in the housing. The cover part 14 has an opening 22 which is coaxial to the pin 18 of the housing part 10. A drive shaft 24 extends through the opening 22 of the cover part 14 from outside into the housing, and is supported with its end region in an opening 26 in the pin 18.

A toothed pinion 30 is supported on the pin 18 of the housing part 10 rotatably about an axis 32 and provided with outer teeth. The tooth pinion 30 is connected through at least one coupling element 34 non-rotatably with the drive shaft 24. A toothed ring 36 is arranged so as to surround the toothed pinion 30 and is provided with inner teeth which engage the outer teeth of the toothed pinion 30. The outer teeth of the tooth pinion 30 have one tooth less than the inner teeth of the toothed ring 36. The toothed ring 36 on its outer periphery has a circular cross-section and is supported over it in an opening 38 of a bearing ring 40 which surrounds the toothed ring 36 so as to rotate about an axis 42. The rotary axis 42 of the toothed ring 36 extends parallel to the rotary axis 42 of the toothed ring 36 of the tooth pinion 30, but is offset relative to the latter by a distance a. The opening 38 is formed in the bearing ring 40 eccentrically to its circular outer cross-section. The toothed pinion 30 and the toothed ring 36 are arranged in the depressions 16, 20 between the housing part 10 and the cover part 14 in direction of their rotary axes 32 and 42 with a small gap. The toothed pinion 30, the toothed gear 36 and the bearing ring 40 are composed preferably of steel, for example sintered steel.

The bearing ring 40 has a substantially smaller cross-section than the depressions 16 and 20 of the housing part 10 and the cover part 14 as shown in the drawings, so as to provide a clearance between the bearing ring 40 and the two-part housing 10, 14. The bearing ring 40 in its outer surface has two axially offset ring grooves 42, in each of which an elastic ring 46 is inserted. The bearing ring 40 is supported via the ring 46 which extends over the outer surface of the bearing ring 40 against the inner surfaces of the depressions 16 and 20. The rings 46 are clamped between the outer surface of the bearing ring 40 and the inner edge of the depressions 16, 20. The toothed pinions 30 is rotatably driven via the drive shaft 24 around the axis 32. By the tooth engagement of the toothed pinion 30 with a tooth ring 36, it is also rotatably driven about its axis 42. Due to the offset position of the rotary axis 42 of the tooth rings 46 relative to the rotary axis 32 of the tooth pinion 30, periodically increasing and reducing chambers are formed between the teeth, so that fuel is supplied from a suction side 48 to a pressure side 49 by the toothed pinion 30 and the toothed ring 36.

A sealing of the chamber between the housing part 10 and the cover part 14, in which the toothed pinion 30 and the tooth gear 36 are arranged, is performed by the ring 46. The suction side 48 is separated from the pressure side 49 by teeth of the toothed pinion 30 and the tooth ring 36 which slide over one another. It is required that between the teeth of the toothed pinion 30 and the toothed ring 36, a radial gap b which is as small as possible be provided, and the rotary axis 32 of the tooth pinion 30 and the rotary axis 42 of the tooth gear 36 be oriented in a radial direction to the rotary axes 2, 42 exactly toward one another.

In accordance with the present invention, an adjusting device 50 is associated with the bearing ring 40. With the adjusting device, the bearing ring 40 and thereby the toothed ring 36 which is supported in it is movable for an adjustment in a radial direction relative to the rotary axes 32, 42, and is blocked in an adjusted position. The direction, in which the bearing ring 40 is movable by the adjusting device, is identified in FIG. 2 with the double arrow 52. The adjusting device is radial both to the rotary axis 42 of the toothed ring 36 as well as to the rotary axis of the tooth pinion 30. The adjusting device 50 is arranged at the side of the rotary axis 32 of the tooth pinion 30 which is opposite to the rotary axis 42 of the tooth ring 46.

The adjusting device 50 has an adjusting element 54 which is fixedly connected with the bearing ring 40. The adjusting element 54 is for example screwed or pressed with a pin 56 which projects from it, in an opening 56 in an outer surface of the bearing ring 40 between the both ring grooves 44. The adjusting element 54 has a slider-shaped portion 60 which is preferably of one piece with the pin 56. A groove 62 is formed in the housing part 10 and in the cover part 14 and each extends from its depression 16 or 20. The depth of the grooves 62 in direction of the rotary axis 32, 42 is smaller than the depth of the depression 16, 20. The grooves 62 starting from the edges of the depressions 16, 20, have first a region **62*a* with a small width and subsequently a region 62*b*** with a greater width.

The slider portion 60 of the adjusting element 54 is displaceably guided between the grooves 62 in their region **62*b*. The width of the slider portions 60 is only a little smaller than the width of the regions 62*b* of the grooves 62 is guided with a small gap. In the adjusting direction 52 the length of the regions 62*b* of the grooves 62 is greater than the length of the slider portion 60, so that it can be displaced in the adjusting direction 52 in the regions 26*b*. The regions 62*b* of the adjusting element 54 can have for example a substantially rectangular cross-section as shown in FIG. 2, and the corners of the cross-section can be rounded. The pin 56 of the adjusting element 54 extends through the regions 62*a* of the grooves 62**.

The adjusting element 54 in its slider portion 60 is provided with a recess 64 formed for example at a through-going opening or a borehole. The recess 64 extends in direction of the rotary axes 32, 42. A fixing element 66 engages in the recess 64. It is formed for example as an adjusting screw which is screwed in a threaded opening 68 in the housing part 10. The adjusting screw 66 extends to the outer side of the housing part 10 and is available there, so that a tool can engage with it and turn it. The adjusting screw 66 at its end which extends outwardly from the housing part 10 is provided for example with a transverse or cross slot, in which a corresponding blade of a screwdriver can be inserted. During turning the adjusting screw 66, due to the threaded connection with the housing part 10 is moved in direction of its longitudinal axis 67. The adjusting screw 66 can have a self-securing thread to guarantee that it can not be turned unintentionally, for example due to vibrations which occur during the operation of the internal gear pump, with a resulting adjustment of the radial gap. Alternatively, the adjusting screw 66 can be secured from rotation by a safety nut which is screwed on the end region extending outwardly beyond the housing part 10.

The recess 64 has a side surface 70 which faces in a radial direction toward the rotary axes 32, 42. The adjusting screw 66 abuts against the side surface 70 with its end region which engages in the recess 64. The side surface 70 of the recess 64 is inclined relative to the longitudinal axis 67 of the adjusting screw 66 so that, the side surface 70 approaches the longitudinal axis 67 toward the cover part 14. The recess 64 of the adjusting element 54 can be formed for example as at least approximately conical opening, so that the inclined arrangement of the side surface 70 is provided. It can be also provided that only the side surface 70 of the recess 64 is arranged inclinedly by corresponding machining with a grinding or milling tool. The side surface 70 of the recess 64 can be formed also as an inclined plane. With the adjusting screw 66 abutting against the side surface 70, the adjusting element 54 is blocked in a definite position in the housing against a restoring force which is actuated by the elastic ring 46. When the adjusting screw 66 is moved by turning in direction of its rotary axis 67, so that it is located differently far in the recess 64, then by the inclined side surface 70 of the adjusting element 54 is moved with its slider portion 60 in the regions **62*b* of the grooves 62 in the adjusting direction 52. Thereby a displacement of the rotary axis 42 of the toothed ring 36 is performed, and thereby also an adjustment of the radial gap between the toothed ring 36 and the toothed pinion 30** is performed.

By turning of the rotary screw 66, it is therefore possible, from outside of the housing and after the complete assembly of the internal gear pump, to adjust the radial gap between the toothed gear 36 and the toothed pinion 30 to a required degree. The further the adjusting screw 66 is turned in, the more the adjusting element 54 is pulled away from the rotary axis 42 of the toothed gear 36 or in other words to the left in FIG. 2, and the smaller is the radial gap b. A restoring force on the bearing ring 40 is produced by the elastically deformable ring 46, so that during a turning out of the adjusting screw 68 the side surface 70 of the recess 64 of the adjusting element 54 remains in abutment against the adjusting screw 66, since the adjusting element 54 is pressed through the bearing ring 40 to the rotary axis 42 of the toothed ring 36. During turning out of the adjusting screw 66, the bearing ring 40 in FIG. 2 is moved to the right and therefore the radial gap b is increased.

During the orientation of the side surface 70 of the recess 64, on which the adjusting screw 66 abuts, to the rotary axes 32, 42, of the toothed pinion 30 and the toothed ring 36 the bearing ring 40 is pulled by the adjusting screw 66 against the restoring force of the ring 46 to a defined position alternatively, it can be provided that the adjusting screw 66 abuts against the opposite side surface of the recess 64 which faces away from the rotary axes 32, 42 and which is arranged correspondingly inclined to the longitudinal axis 67 of the adjusting screw 66. In this case the bearing ring 40 is pressed by the adjusting screw 66 against the restoring force of the ring 46 in a defined position.

It will be understood that each of the elements described above, or two or more together, may also find a useful application in other types of constructions differing from the types described above.

While the invention has been illustrated and described as embodied in internal gear gap, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

We claim:

1. An internal gear pump, comprising a housing; a toothed ring provided with inner teeth; a bearing ring supporting said toothed ring in said housing rotatably about a rotary axis; a toothed gear provided with outer teeth and engaging with said toothed ring, said toothed gear being rotatable in said housing about a rotary axis, at least one of said toothed gear and said toothed ring being rotatably driven, said rotary axis of said toothed ring being offset relative to said rotary axis of said toothed gear; and an adjusting device associated with said bearing ring for moving said bearing ring in a radial direction relative to said rotary axis of said toothed ring in said housing for an adjustment and for blocking it in an adjusted position, said adjusting device having an adjusting element which is connected with said bearing ring and is displaceably guided in said housing in a radial direction, and a fixing element which is accessible from an outer side of said housing and is connected with said housing and also engages said adjusting element, so that said adjusting element is displaceable in the radial direction and blockable in an adjusted position by said fixing element.

2. An internal gear pump as defined in claim 1, wherein said adjusting element has a recess which is at least approximately conical.

3. An internal gear pump as defined in claim 1, wherein said direction in which said bearing ring is movable by said adjusting device is radial both to said rotary axis of said toothed ring and to said rotary axis of said toothed gear.

4. An internal gear pump, comprising a housing; a toothed ring provided with inner teeth; a bearing ring supporting said toothed ring in said housing rotatably about a rotary axis; a toothed gear provided with outer teeth and engaging with said toothed ring, said toothed gear being rotatable in said housing about a rotary axis, at least one of said toothed gear and said toothed ring being rotatably driven, said rotary axis of said toothed ring being offset relative to said rotary axis of said toothed gear; and an adjusting device associated with said bearing ring for moving said bearing ring in a radial direction relative to said rotary axis of said toothed ring in said housing for an adjustment and for blocking it in an adjusted position, said adjusting device having an adjusting element which is connected with said bearing ring and is displaceably guided in said housing in a radial direction, and a fixing element which is accessible from an outer side of said housing and is connected with said housing and also engages said adjusting element, so that said adjusting element is displaceable in the radial direction and blockable in an adjusted position by said fixing element, said adjusting element has a recess in which said fixing element engages transversely to the radial direction, said fixing element abutting against a side surface of said recess which faces radially toward said rotary axis of said toothed ring or faces away from the same, said fixing element being movably connected with said housing in direction of a longitudinal axis of said fixing element, said side surface of said recess being inclined relative to said longitudinal surface of said fixing element, so that by moving said fixing element in direction of its longitudinal axis over said inclined side surface of said recess, a movement of said adjusting element in the radial direction is activated.

5. An internal gear pump as defined in claim 4, wherein said fixing element is formed as an adjusting screw which is screwed in a threaded opening of said housing, said adjusting screw during a rotary movement performing an adjusting movement in direction of its longitudinal axis.

6. An internal gear pump as defined in claim 4, and further comprising at least one elastic ring which supports said bearing ring and is clamped between an outer surface of said bearing ring and said housing, so that a restoring force acts on said bearing ring against an adjusting force produced by said adjusting device on said bearing ring.

7. An internal gear pump as defined in claim 6, wherein said at least one elastic ring is formed as a sealing element which seals said housing.

* * * * *